United States Patent [19]

Furuya et al.

[11] 4,313,290

[45] Feb. 2, 1982

[54] APPARATUS FOR PACKING

[75] Inventors: Michio Furuya, Kashiwa; Susumu Sakamoto, Tokyo, both of Japan

[73] Assignee: Tokyo Automatic Machinery Works, Ltd., Tokyo, Japan

[21] Appl. No.: 100,182

[22] Filed: Dec. 4, 1979

[51] Int. Cl.[3] ..... B65B 11/18; B65B 7/02

[52] U.S. Cl. ..... 53/230; 53/232; 53/378

[58] Field of Search ..... 53/466, 480, 228, 230, 53/232, 378, 231, 379, 229; 93/183, 262, 263

[56] References Cited

U.S. PATENT DOCUMENTS

| | | | |
|---|---|---|---|
| Re. 18,341 | 1/1932 | Smith | 53/228 X |
| 724,230 | 3/1903 | Wyman | 53/378 X |
| 2,584,529 | 2/1952 | Allen | 53/378 |
| 2,696,702 | 12/1954 | Martin | 53/230 |
| 3,006,119 | 10/1961 | Fingerhut | 53/230 X |
| 3,286,482 | 11/1966 | Long | 53/480 |
| 3,507,091 | 4/1970 | Mizelle | 53/230 X |
| 3,855,758 | 12/1974 | Walter | 53/230 X |
| 4,206,579 | 6/1980 | Woxland | 493/183 X |

FOREIGN PATENT DOCUMENTS

| | | | |
|---|---|---|---|
| 934150 | 9/1955 | Fed. Rep. of Germany | 53/230 |
| 575080 | 2/1946 | United Kingdom | 53/231 |

*Primary Examiner*—John Sipos

*Attorney, Agent, or Firm*—Sandler & Greenblum

[57] ABSTRACT

A method and apparatus for packing a box or other product is disclosed which involves wrapping a packing sheet about the product in an improved fashion. The method includes lapping the packing sheet around the product, folding opposed side edges of end portions of the packing sheet over ends of the product and folding upper and lower edges of the folded end portions of the sheet over the product ends. The upper edges of the sheet are folded upwardly at the same time that side edges are folded over at least one end of the product. Upper and lower edges of the end portions are then folded over the product ends and attached to each other. The apparatus for performing the method includes a packing sheet lapping section, a product transfer path located adjacent to a leading side of the lapping section, a pusher positioned adjacent to a trailing side of the lapping section and a plurality of folding elements. Separate folding structure is provided for folding opposed side edges of the packing sheet end portions over the ends of the product while also upwardly folding upper edges of the end portions, for folding lower edges of the end portions over the ends of the product and for folding the upwardly folded upper edges of the end portions over the ends of the product. The structure for folding the opposed side edges and upper edges of the packing sheet end portions can be stationary, moveable in a straight line, pivoted or swinging. The upper edges of the end portions can be upwardly folded by folding structure located at both sides of the packing sheet lapping section or folding structure located at only one side of the lapping section.

11 Claims, 31 Drawing Figures

APPARATUS FOR PACKING

BACKGROUND OF THE INVENTION

1. Field of the Invention

The present invention relates generally to a method and an apparatus for packing and more particularly to a method and an apparatus for packing which includes structure for lapping and folding a packing sheet around a box or similar product.

Packing apparatus formed in accordance with the present invention can be installed and advantageously used in a number of different applications, e.g., packing factories, working sites and particularly in department stores, supermarkets and souvenir shops located in sight-seeing areas. The apparatus permits efficient wrapping of gifts and similar items.

2. Description of the Prior Art

The prior art discloses a method of packing which comprises lapping a packing sheet around a box or similar product and folding opposite side edges of rectangular end portions of the packing sheet which extend beyond the ends of the box or other product. The opposite side edges are folded after or during the lapping step and thereafter upper and lower edges of the sheet are folded over the ends of the box or product.

However, during the step of folding the packing sheet, the upper edge of each rectangular end portion of the packing sheet, which has an ear-like configuration obtained by folding the opposite side edges of the end portion, is folded downwardly directly over the end of the box or product. Therefore, unless folding pawls which are normally used for folding the side edges of the sheet have a height substantially equal to the height of the box or product, the upper edge cannot be formed into a predetermined ear-like form. In the case of packing boxes or other products having different heights, therefore, it has previously been necessary to adjust the height level of the folding pawls according to the height of each product or to replace the pawls with pawls having different heights which correspond to the height of an individual box or product. This enables the ear-like portion to be folded downwardly directly over a product end.

SUMMARY OF THE INVENTION

Accordingly, in view of the above stated deficiencies in the prior art, it is a general object of the present invention to provide a new and improved method and apparatus for packing in which a packing sheet is folded about a box or other product.

Another object of the present invention is to provide a method and apparatus for packing in which a packing sheet is folded about a product so that a predetermined ear-like upper edge will be created by folding opposite side edges of the sheet. An appropriate edge will be created each time the apparatus and method are used, independently of the size of the product (i.e., preferably without adjustment of the height of folding pawls or having to replace parts, and with improved control of the folding operations).

A further object of the present invention is to provide a method and apparatus for packing in which a packing sheet is folded about a box or other product which includes means for upwardly folding the upper edge of each open end portion of the packing sheet formed during the main folding step (i.e., at the time that at least one of the opposite side edges are folded, the upper edge also will be upwardly folded).

An additional object of the present invention is to provide a method and apparatus for packing in which a packing sheet is folded about a box or other product so that an upper edge of each open end portion of the folded packing sheet is folded from an upwardly directed position over a lower edge of each portion which is folded directly over one end of the product.

Upon further study of the specification and appended claims, further objects, features and advantages of the present invention will become more fully apparent to those skilled in the art to which this invention pertains.

Briefly, the above and other objects, features and advantages of the present invention are attained in one aspect thereof by providing a method of packing a product which comprises lapping a packing sheet around the product. The method includes folding opposed sides edges of rectangular end portions of the packing sheet which extend beyond opposite ends of the product over the product ends, and then folding upper and lower edges of the end portions over the product ends. The upper edges are upwardly folded at the same time that the side edges of at least one of the end portions are being folded over the product ends and the upper and lower edges are subsequently folded over the product ends.

The above and other objects, features and advantages of the present invention are attained in another aspect thereof by providing an apparatus for packing a product which comprises a packing sheet lapping section for lapping a packing sheet around the product, said packing sheet having opposed end portions extending beyond opposed ends of the product. A product transfer path is located adjacent to one side of the lapping section and a pusher is positioned adjacent to another side of the lapping section, the pusher adapted to move the product along the transfer path. First folding means are located on at least one of the lapping section sides for folding opposed side edges of at least one of the packing sheet end portions over the product ends while also upwardly folding upper edges of the ends portions. Second folding means for folding lower edges of the end portions over the product ends are provided, as are third folding means for folding the upwardly folded upper edges of each end portion over the ends of the product. The second and third folding means are positioned along the transfer path.

BRIEF DESCRIPTION OF THE DRAWING

The above and other objects, features and advantages of the present invention will be more fully apparent to those of ordinary skill in the art to which this invention pertains from the following detailed description when considered in connection with the accompanying drawings, in which like reference characters designate like or corresponding parts throughout the several views and wherein.

DESCRIPTION OF PREFERRED EMBODIMENTS

Figure 1:
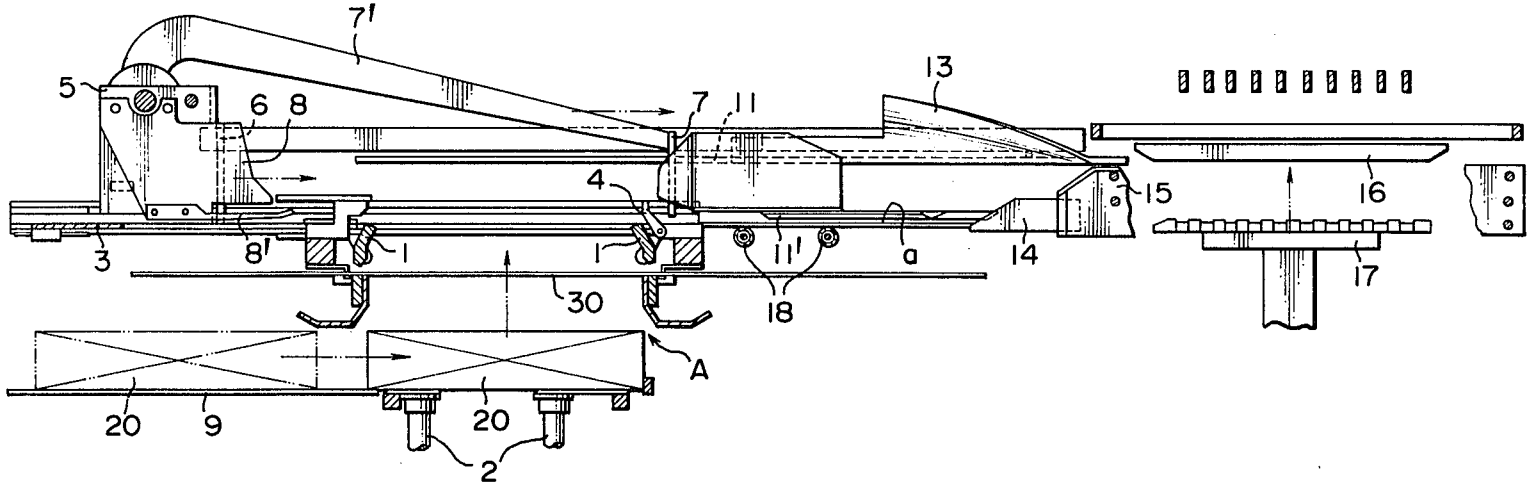
FIG. 1 is a partially broken-away side view showing packing apparatus in accordance with the present invention.

More specifically, the method for packing in accordance with the present invention includes, in a method of packing a box or product by lapping a packing sheet around the product, the steps of folding opposite side edges of each rectangular end portion of the packing sheet which extends beyond an end of the product over the ends of the product and then folding the upper and lower edges of the end portions over the ends of the product. The method further comprises upwardly folding the upper edge of each open end portion while the opposite side edges of each end portion are being folded over the end of the product and then folding the upper and lower edges over the end of the product.

The apparatus for packing formed in accordance with the present invention comprises a packing sheet lapping section for lapping a packing sheet around a product into a rectangular form having opposite open end portions extending from opposite ends of the product, a product transfer path adjacent to and generally continuous with the packing sheet lapping section, a pusher located on one side of the packing sheet lapping section and serving to transfer the product along the transfer path, first folding means provided on at least one of the pusher side and the transfer path side of the packing sheet lapping section, the first folding means serving to fold the opposite side edges of the open end portions of the packing sheet over the ends of the product while also upwardly folding the upper edges of the open end portions, second, lower edge folding means for folding the lower edges of the open end portions over the ends of the product, and third, upper edge folding means for folding the upper edges, which were folded by the first folding means, over the ends of the product, the upper and lower edge folding means being provided along the transfer path forwardly of the first folding means.

The open end portions of the packing sheet extending beyond the opposite ends of the product are formed while in the packing sheet lapping section, and the first folding means, lower edge folding means, and upper edge folding means are provided for folding the open end portions.

The folding means function to fold the opposite side edges of the open end portions over the ends of the product at the same time and can also continuously fold the horizontally projecting upper edge vertically upward from either end or from both of the opposed ends of the upper edge.

The first folding means includes members provided on the trailing pusher side and the leading transfer path side of the packing sheet lapping section. Only one of the members, however, need be capable of upwardly folding the upper edges. In other words, by providing first folding members for folding the opposite side edges of each open end portion located on one side of the lapping section and second folding members on the other side of the lapping section for folding the opposite side edges and upwardly folding the entire upper edge, it is possible to upwardly fold the whole upper edge of the open end portion. Of course, it is most effective to provide first and second folding members on two sides so that members on each side fold the opposite side edges and upwardly fold the upper edge of opposed sheet end portions.

There is no restriction upon the order of operation of the folding members on the two sides; they may be simultaneously operated or either may be operated before the other.

The folding members may be moveable for linear reciprocation in directions perpendicular to the open end portions of the packing sheet, moveable for swinging across the open end portions, or stationary, i.e., held in a stationary position to be engaged by the open end portions of the packing sheet. If desired, a combination of various folding members may be utilized in one apparatus.

Since in accordance with the present invention a method of packing by lapping a packing sheet around a product which comprises folding the opposite side edges of rectangular end portions of the packing sheet extending beyond the ends of the product over the ends of the product and then folding the upper and lower edges of the opened end portions formed over the ends of the product is carried out with the folding means for folding the opposite side edges of each open end portion of the packing sheet lapped around the product over the ends of the product while upwardly folding the upper edge of each open end portion, as the opposite side edges of the open end portions of the packing sheet are folded over the ends of the product, the upper edges are folded vertically upward.

With the upward folding of the upper edges of each open end portion that occurs concurrently with the folding of the opposite side edges, the upper edges of the sheet are formed into a predetermined ear-like shaped portion with their opposed ends folded back into a triangular form. Each ear-like portion extends from and above the top of the product. The predetermined shape of the upper edges of the packing sheet can be obtained independently of the height of the product, since the upper edges of the sheet can be continuously raised.

Thus, the present invention provides a packing apparatus which requires neither adjustment of the height of folding pawls for folding the side edges of the opened end portions in accordance with the height of the product nor replacement of pawls which would increase the efficiency of the packing operation.

FIG. 1 illustrates a packing apparatus having a packing sheet lapping section A disposed on the left side of the figure and a transfer path "a" extending to the right of supports 1 of packing sheet lapping section A. A box or other product 20 in which a commodity may be packed and a packing sheet 30 are also illustrated.

Figure 2:
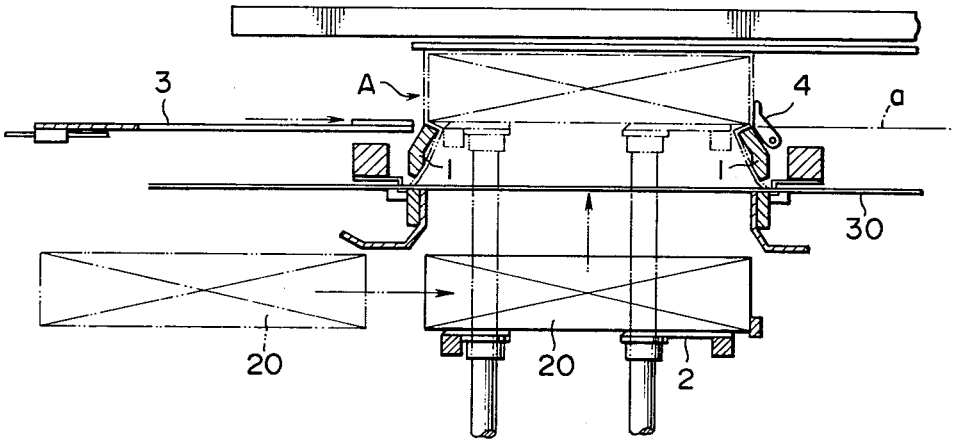
FIG. 2 is a fragmentary side view of the apparatus of FIG. 1 in which a box and packing sheet are being initially positioned.
Figure 9:
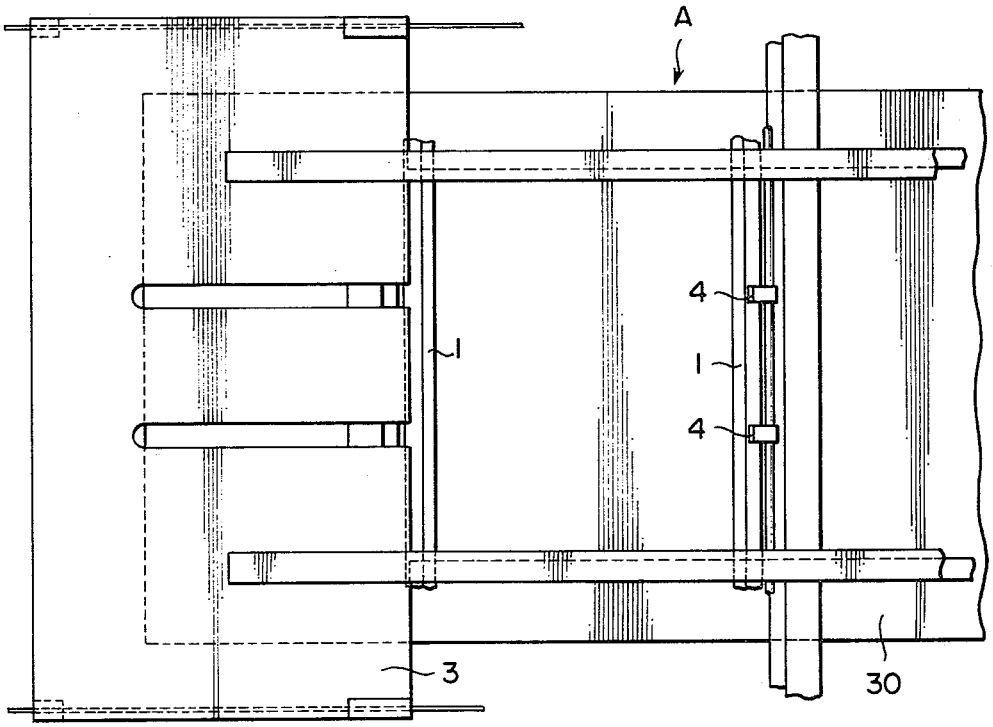
FIG. 9 is a plan view of the apparatus as illustrated in FIG. 2.
Figure 10:
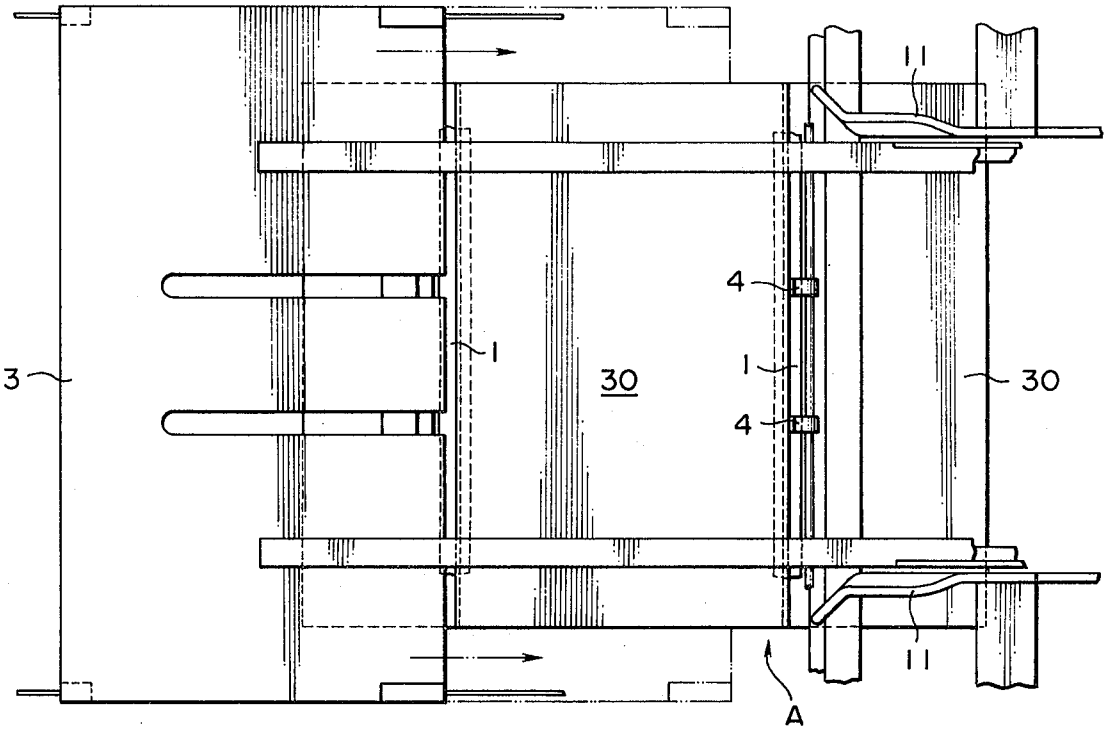
FIG. 10 is a plan view of the apparatus as illustrated in FIG. 3.

In lapping section A, an elevator 2 is provided directly beneath supports 1. The supports are adjustably spaced to correspond to the width of product 20. Bottom folding members 3 are provided rearwardly of supports 1 and the members are adapted to be reciprocated horizontally between the front and rear (or leading and trailing, respectively) supports 1. Adjacent to leading side support 1 (positioned on the right side of the section), support pawls 4 are provided in a turned-down position. The pawls are adapted to be held upright until a predetermined load, such as that applied when a box or other product is forced over the pawls, is applied to them. The pawls are illustrated in FIGS. 1, 2 and 9.

Figure 4:
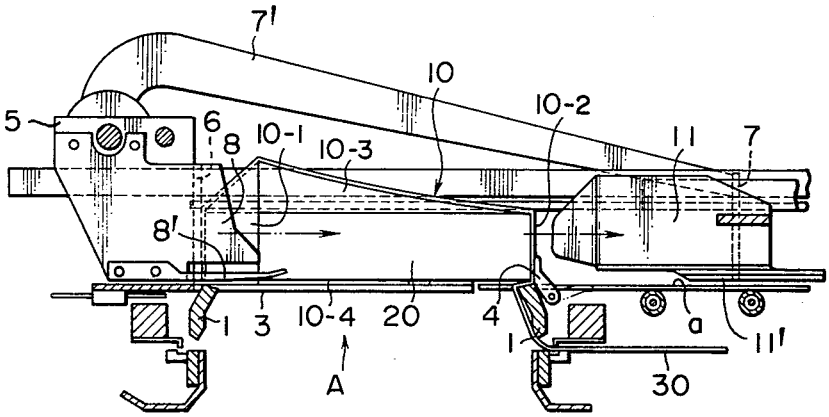
FIG. 4 is a fragmentary side view of the apparatus of FIG. 1 as it folds one side portion and an upper edge portion of the packing sheet.
Figure 11:
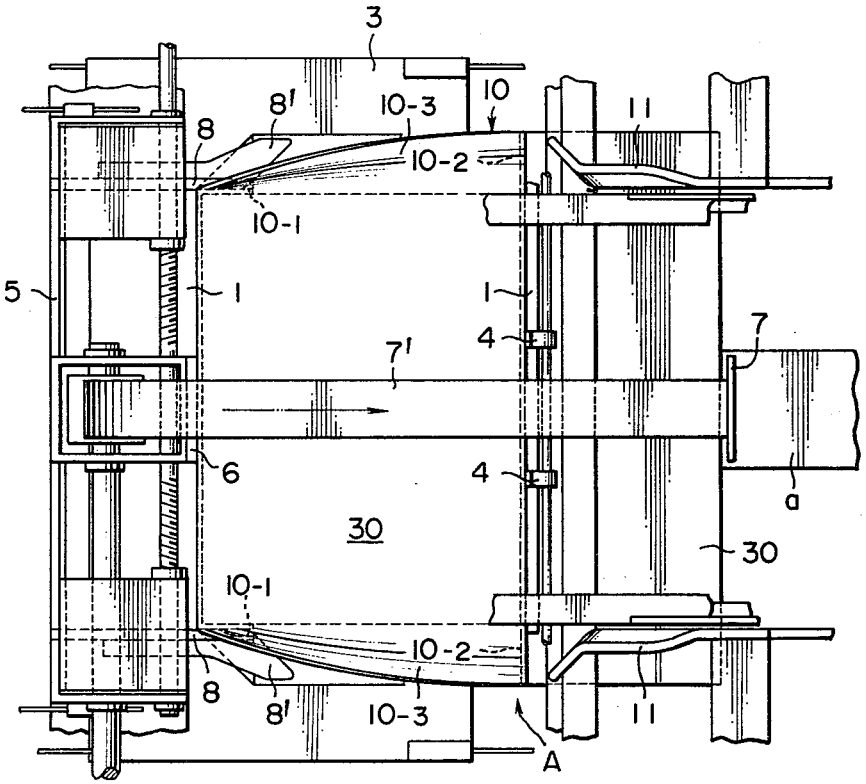
FIG. 11 is a plan view of the apparatus as illustrated in FIG. 4.

In front of the supports 1 a moveable frame 5 moved by a moving means for horizontally moving the bottom folding members 3 back and forth along transfer path "a" is provided. A moveable frame 5 carries a first pusher 6 adapted to be moved back and forth along transfer path "a" over supports 1 and a second pusher 7 extending over the transfer path "a". The second pusher is coupled through an arm 7' to moveable frame 5 for reciprocation in interlocked relation, as illustrated in FIGS. 1, 4 and 11.

The movements of the box or product and the packing sheet are from left to right during the packing process, as viewed in FIG. 1. Accordingly, "forward" as used herein shall be defined as further to the right, and "rearward" as being further to the left, and this shall be applicable as viewed in FIG. 1 and the other Figures.

Arm 7' is vertically pivotable, and during rearward movement of moveable frame 5, the arm 7' is raised so that the pusher 7 is moved into a position located above the product along transfer path "a".

Folding members 8 are adjustably mounted upon moveable frame 5 on opposite sides of the pusher 6 so that their spacing can be adjusted according to the length of the product 20.

The folding members 8 are fixed in adjusted positions such that they can engage the opposite ends of the product 20, as taken in the lengthwise direction of the product. Each folding member 8 has a lower edge portion 8' positioned to extend directly above supports 1 (i.e., at substantially the same level as the bottom of the product 20 resting on the supports) and sidewise of the supports, the remainder of each folding member extending upright. The folding members 8 each has a height such that it suitably extends above the product 20.

Further, the folding member 8 extends forwardly lengthwise beyond the pusher 6 by a suitable margin in the direction of transfer.

Packing sheet 30 has a size selected in relation to the size of the product 20 and is supplied to the space between the elevator 2 and supports 1. Rearwardly of elevator 2, a transfer path 9 for transferring one product 20 onto elevator 2 is provided.

In the packing sheet lapping section A, the product 20 which has been transferred from the transfer path 9 onto the elevator 2 is raised by the elevator through the space between the supports 1 while pushing up the packing sheet 30. Eventually, pressure from the product and sheet push open the ends of the supports 1 and so that they can rest upon the supports. The elevator 2 is subsequently lowered. This part of the method is illustrated in FIGS. 2, 3, 9 and 10.

Figure 3:
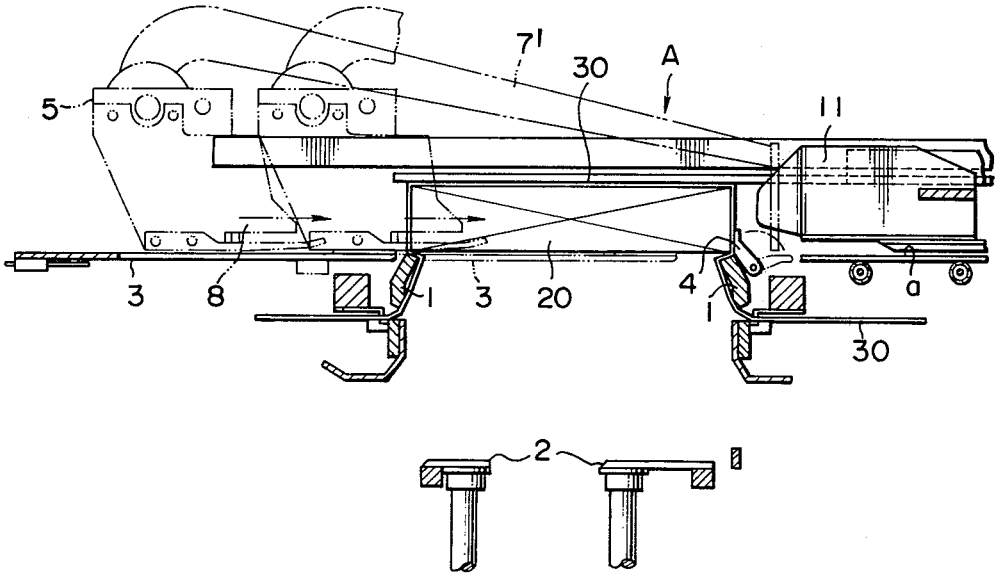
FIG. 3 is a fragmentary side view of the apparatus of FIG. 1 in which a packing sheet is being lapped about a box or product.

Thereafter, as illustrated in FIG. 3, the bottom folding members 3 are advanced along the bottom of the product 20 to fold a trailing portion of the packing sheet 10 over the bottom of the product. At the same time, the moveable frame 5 is advanced to let the folding members 8 fold the trailing side edges 10-1 of the open end portions 10 of packing sheet 30, which edges extend beyond the opposite ends of the product 20, over the ends of the product, and to upwardly fold the upper edges 10-3 of the open end portions, as illustrated in FIGS. 4 and 11. Soon afterwards, the pusher 6 is caused to engage the product 20 and pushes it forwardly along transfer path "a" such that a leading portion of packing sheet 30 is folded over the bottom of the product 20 by the leading (right) side support 1, the support at this stage serving as a folding member to complete the lapping of the packing sheet 20 around the product 30.

In this embodiment, the folding of the trailing side edges 10-1, upward folding of the upper edges 10-3 and folding of the leading side edges 10-2 (the latter hereinafter described) are all done during the step of lapping the packing sheet around the product.

On the transfer path "a", folding members 11, return members 13, lower edge folding members 14, guide members 15 and upper edge folding members 16 are provided substantially along lines passing through the folding members 8. Elevators 17 are provided below the space between the upper edge folding members 16 which are provided at the leading or forward end of the transfer path "a".

The folding members 11 are stationary and are disposed directly forward of leading support 1 and slightly on the outer side of the folding members 8, each folding member 11 having a lower edge portion 11' extending at substantially the same level as the lower edge portions 8' of each folding member 8.

Heaters 18 are provided beneath the folding members 11 and serve to bond the overlapped portions of the packing sheet 30 together over the bottom of the product.

Figure 12:
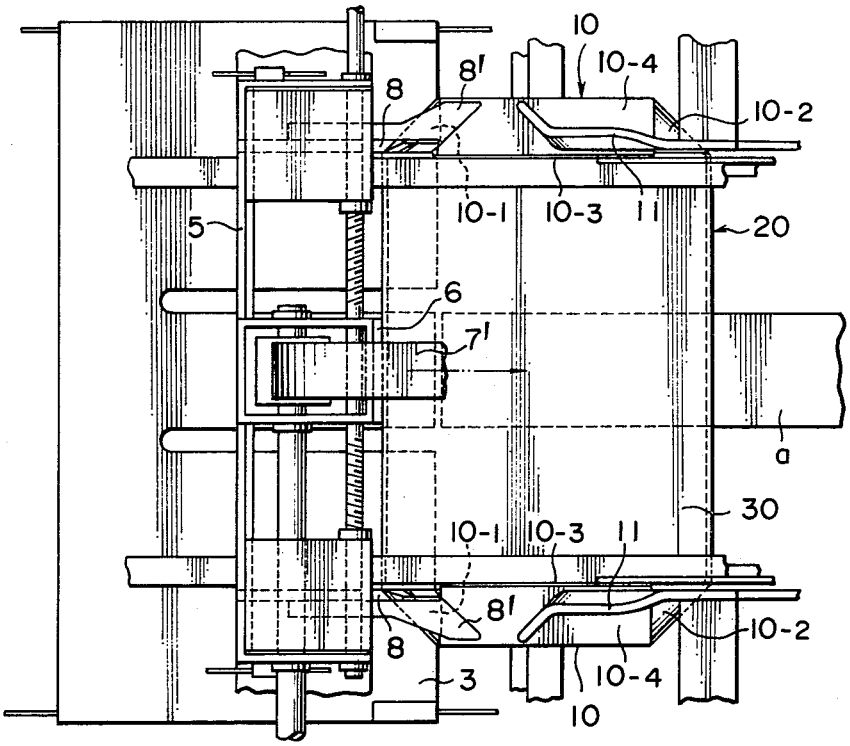
FIG. 12 is a plan view of the apparatus as illustrated in FIG. 5.

Each folding member 11 includes an upright member projecting from its lower edge portion 11' and a trailing end portion rearwardly projecting from the lower edge portion. The upper edge of each member 11 extends beyond the product 20 to a suitable extent. Folding members 11 have upper portions slightly inclined outwardly from the center of the apparatus, so that folding members 8 can be moved within the inner surfaces of the members 11, as illustrated in FIGS. 1, 5 and 12.

Figure 5:
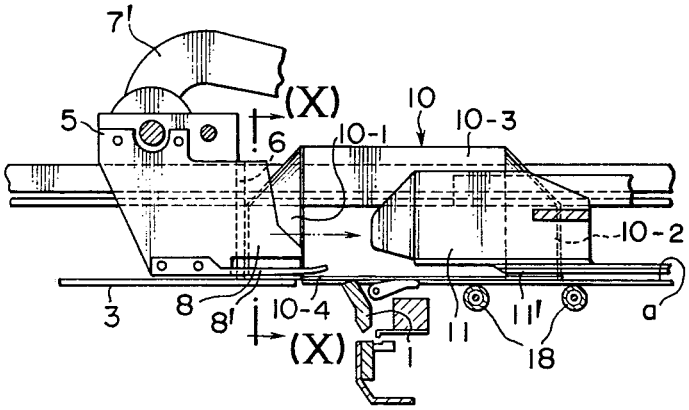
FIG. 5 is a fragmentary side view of the apparatus of FIG. 1 as it folds another side of the packing sheet.
Figure 6:
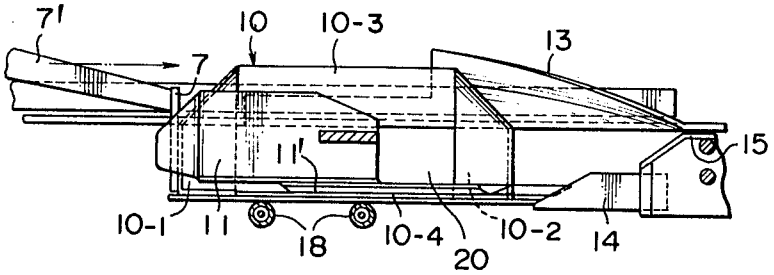
FIG. 6 is a fragmentary side view of the apparatus of FIG. 1 in which an upper packing sheet edge is being directed outwardly.

Folding members 11 serve to fold the leading side edges 10-2 of the open end portions 10 of packing sheet 30 over the ends of the product while also upwardly folding the upper edges 10-3 of the open end portions 10, as illustrated in FIGS. 5 and 6.

Return members 13 are provided on the inner side of the folding members 11 and lower edge folding members 14 are provided on the outer side of leading end portions of the return members 13.

The return members 13 are plates, each plate having a substantially upright trailing (left) end, an intermediate portion gradually turning down to the outside, (as viewed in the forward direction) and a horizontal leading end. The upper edges 10-3 that are folded by the folding members 11 to extend vertically upright are gradually returned to horizontal position by the return members 13, as illustrated in FIGS. 1, 6, 7, 13 and 14.

Figure 7:
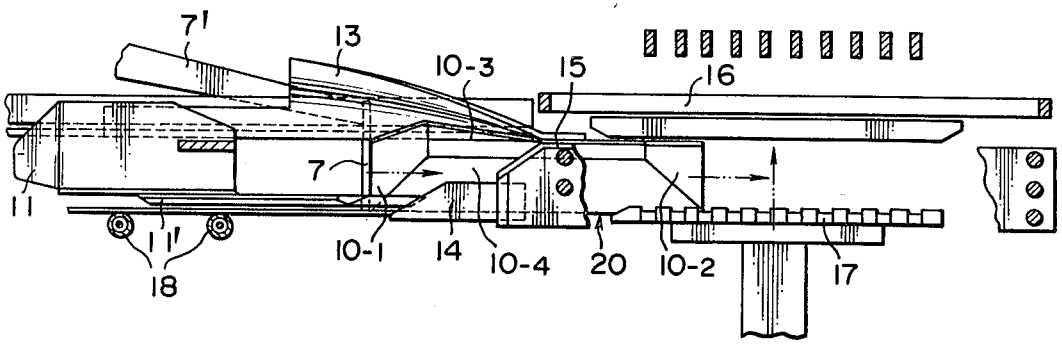
FIG. 7 is a fragmentary side view of the apparatus of FIG. 1 in which a lower edge of the packing sheet is being folded upwardly over the product end.
Figure 14:
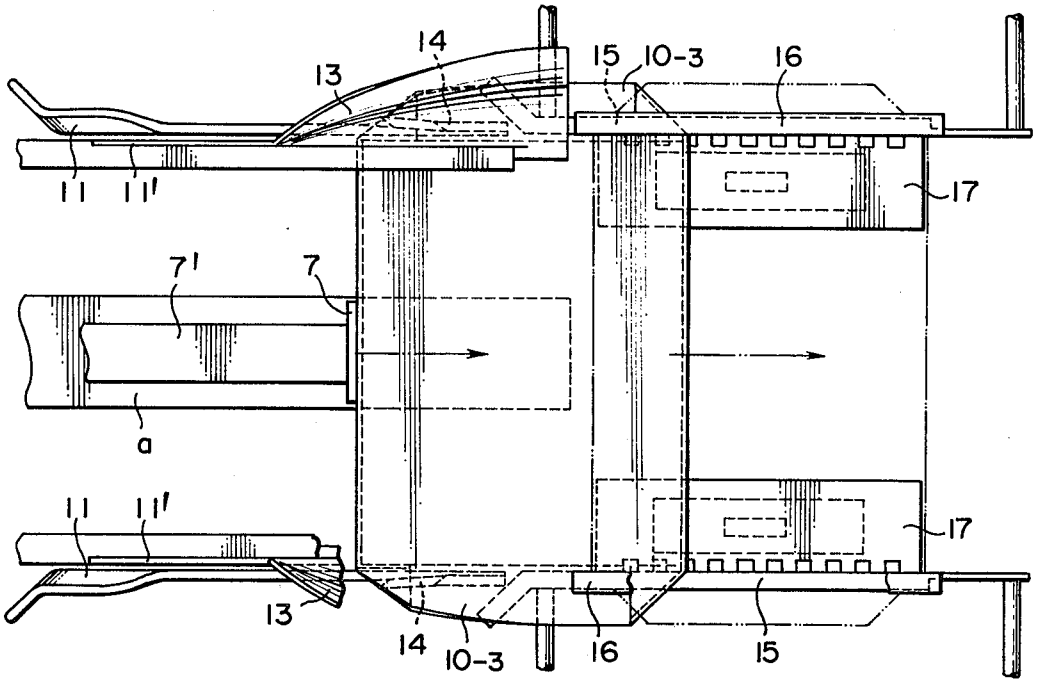
FIG. 14 is a plan view of the apparatus as illustrated in FIG. 7.
Figure 15:
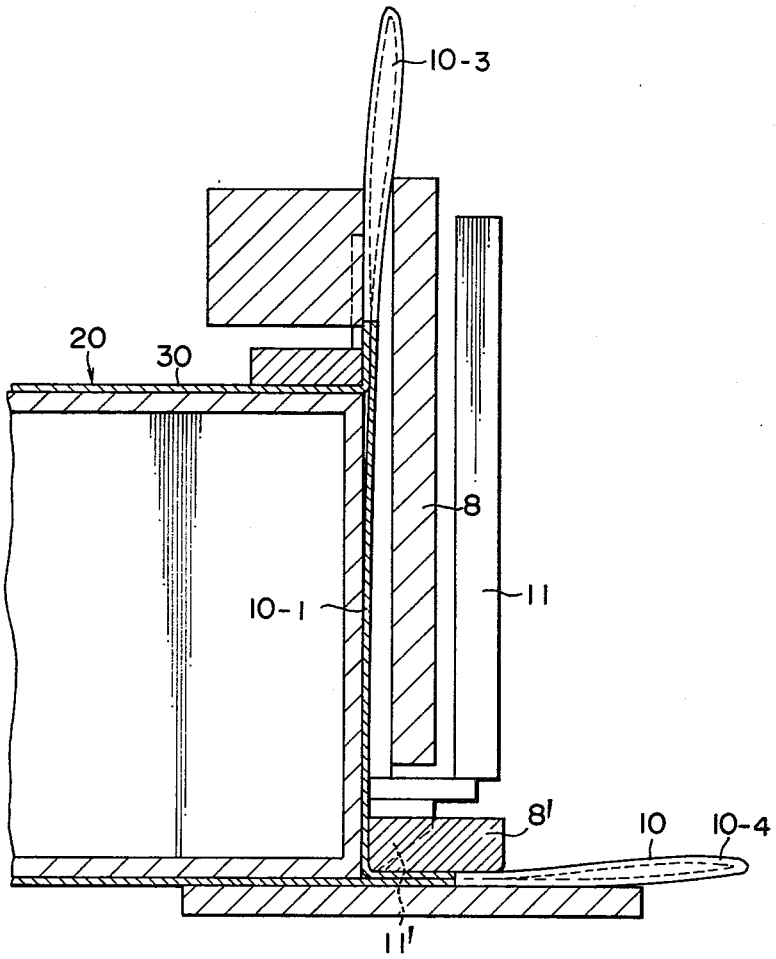
FIG. 15 is an enlarged-scale sectional view taken along line X—X in FIG. 5.

The lower edge folding members 14 are vertical plates disposed to correspond to the trailing half of the return members 13, as seen in FIG. 1. Each plate has a main portion having a given height which extends for a length corresponding to the length of return member 13 between its leading end and a generally vertical intermediate portion of each return member 13. Each plate also has a trailing end inclined upwardly and forwardly toward said main portion. The lower edge folding members are illustrated in FIGS. 1, 7 and 14.

The lower edge folding members 14 serve to fold the lower edges 10-4 of open end portions 10 over the ends of the product 20 after the opposite side edges 10-1 and 10-2 are folded.

Guide members 15 comprise horizontal plates, each plate being located adjacent to the leading end of a return member 13 and extending forwardly therefrom. More particulary, the trailing end portion of each guide member is of a predetermined length and extends along and is appropriately spaced apart from the underside of a leading end portion of each return member 13. This arrangement serves to guide the upper edges 10-3 of the open end portions 10, having previously been rendered horizontal by return members 13, in their horizontal position along the upper surfaces of the guide members 15, up to a position over the elevators 17 provided at the leading end of transfer path "a" in order to transfer the product 20, as illustrated in FIGS. 1, 7 and 14.

Figure 8:
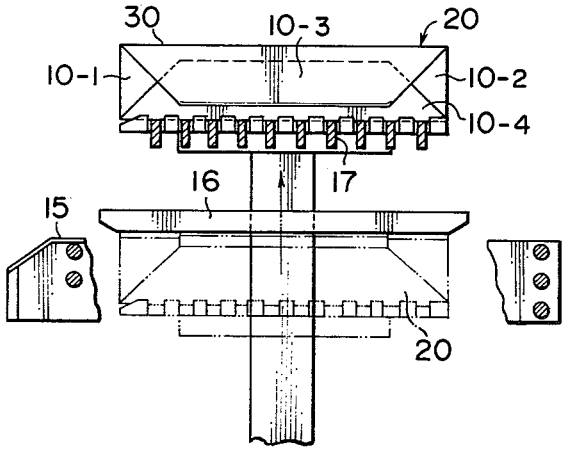
FIG. 8 is a fragmentary side view of the apparatus of FIG. 1 in which the upper edge is being folded downwardly over one end of the product.

The upper edge folding members 16 are rod-like members extending above and parallel to the guide members 15. As the product 20 is raised by the elevators 17 through the space between the upper edge folding members 16, the upper edges 10-3 which have been held horizontally are folded over the ends of the product by the lower portion of the folding members 16, as illustrated in FIGS. 7, 8 and 14.

The return members 13, guide members 15, upper edge folding members 16 and elevators 17 constitute an upper edge folding mechanism for folding the upper edges 10-3 of the sheet over the ends of the product.

The process of folding the open end portions 10 will now be described with reference to FIGS. 5 through 15. With the product 20 on supports 11, folding members 8 effect folding of the trailing side edges 10-1 and also the upward folding of trailing portions of the upper edges 10-3. The product is then transferred along transfer path "a" by the pusher 8 together with the movement of moveable frame 5. The leading side edges 10-2 of the open end portions 10 being moved eventually engage the folding members 11 and are thereby folded over the ends of the product and the upper edges 10-3 are continuously folded upwardly, as seen in FIGS. 5 and 12. This continuous folding of the upper edges is achieved even though the opposed side edges are folded by independent folding members 8 and 11.

With the upward folding of the upper edges 10-3 occurring simultaneously with the folding of the leading side edges 10-2, each upper edge 10-3 is formed into a predetermined ear-like shape with its opposite side ends folded into a triangular form, as seen in FIGS. 5 and 6.

Figure 13:
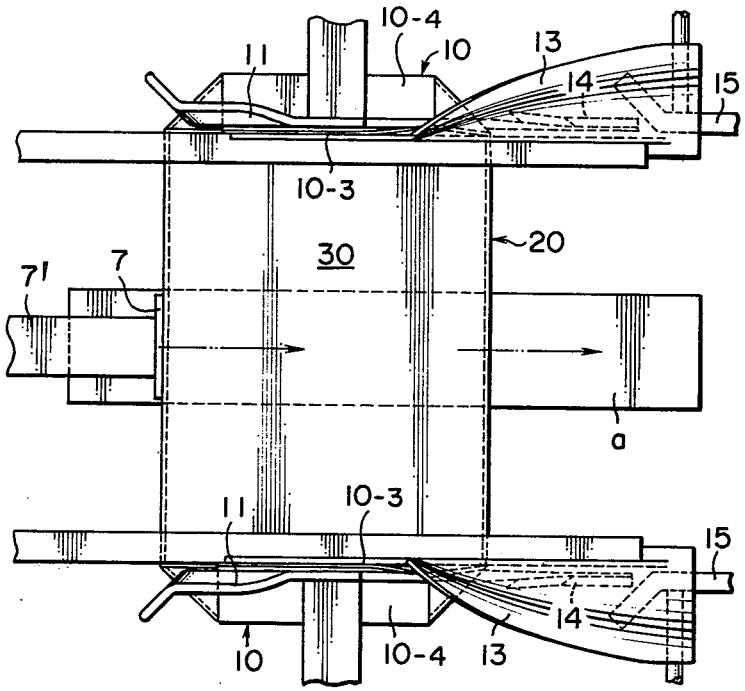
FIG. 13 is a plan view of the apparatus as illustrated in FIG. 6.

The subsequent forward transfer of the product 20 is effected by the pusher 7 after completion of one stroke of the moveable frame, as seen in FIGS. 6 and 13.

As the product is being transferred by the pusher 7, the upper sheet edges 10-3 which were upwardly folded engage the return members 13 and are returned into horizontal position along the return members 13, while the lower sheet edges 10-4 engage the lower edge folding members 14 and are thereby folded against the ends of the product. Upper edges 10-3 are subsequently transferred in horizontal position along guide members 15 and onto elevators 17 at the leading end of the transfer path "a", as seen in FIGS. 7 and 14. During this transfer, glue is applied to the underside of the horizontal upper edges 10-3 by glue application means (not shown). Many conventional means for applying glue, e.g. hot melt adhesive applicators, could be utilized.

The elevators 17 are then raised in order to raise product 20 through the space between upper end folding members 16. As upper sheet edges 10-3 clear members 16, they are then folded over the ends of the product, overlapped over the previously folded lower edges 10-4, and bonded thereto by the previously applied glue, as seen in FIG. 8.

Modifications of the folding means, which comprise an essential element of the present invention, will be hereinafter described. For the sake of facilitating these descriptions, parts similar to those in the preceding embodiment are designated by like reference numerals and are not further described.

Figure 16:
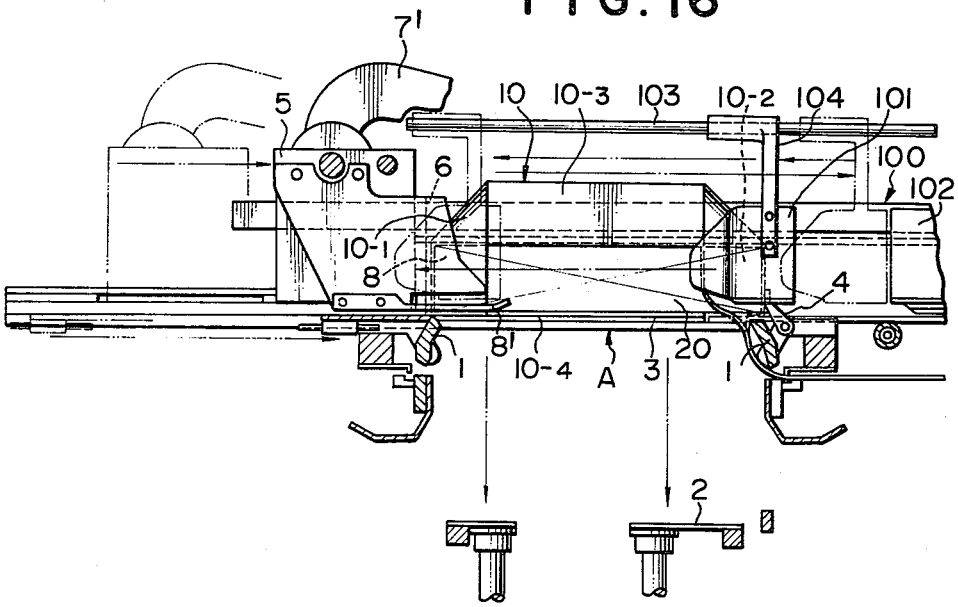
FIG. 16 is a partially broken-away side view illustrating a second embodiment of packing apparatus formed in accordance with the present invention.
Figure 17:
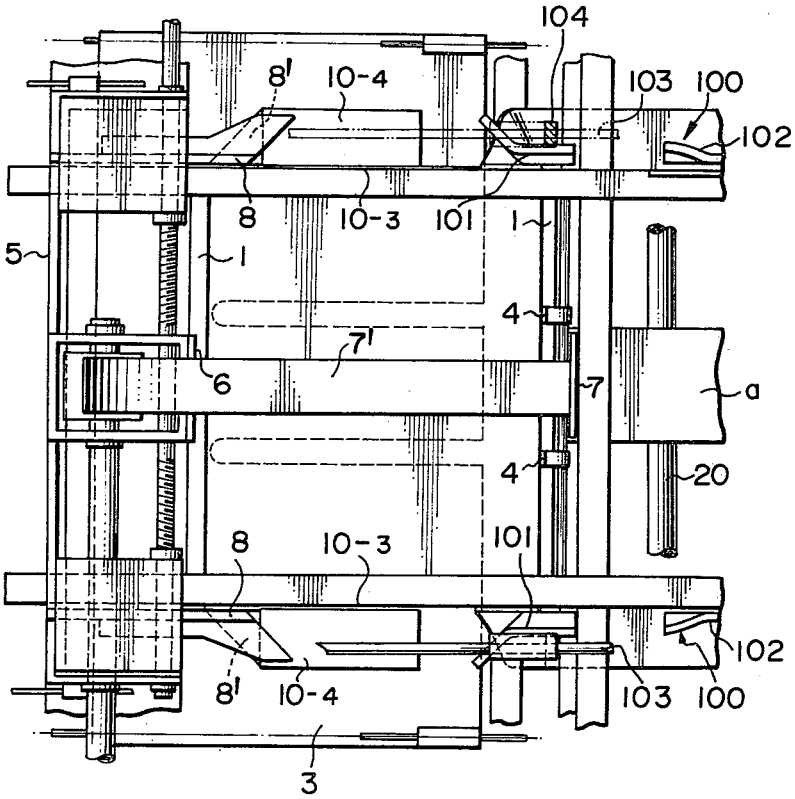
FIG. 17 is a plan view of the apparatus as illustrated in FIG. 16.

In the embodiment illustrated in FIGS. 16 and 17, folding means 100 provided on the transfer path side of the packing sheet lapping section A include moveable folding members 101 and stationary folding members 102, and folding members 101 are adapted to be moved toward the lapping section A concurrently with the movement of folding members 8 on the side of the pusher 6. The folding members 101 and 102 are plate members extending upright from their respective lower edge portions 101' and 102', which have the same height as the lower edge portions 8' of the folding members 8. Folding members 102 are disposed in stationary position and are initially placed with and adjacent to the respective moveable folding members 101 which are provided on the trailing side.

The moveable folding members 101 are coupled to operating arms 104 and are slideable along guide members 103. Members 101 are advanced toward and moved away from lapping section A by the arms.

After the product 20 is raised by elevator 2 in packing sheet lapping section A, and the packing sheet 30 pushed up to clear and rest upon supports 1, bottom folding members 3 are advanced along the bottom of product 20 to fold the trailing portion of packing sheet 30 over the bottom of product 20. Thereafter, folding members 8 and 101 are simultaneously moved toward the packing sheet lapping section A to fold the respective trailing side and leading side edges 10-1 and 10-2 of the open end portions 10 of the packing sheet 30 over the ends of the product while also folding the upper edges 10-3 vertically upward.

Figure 18:
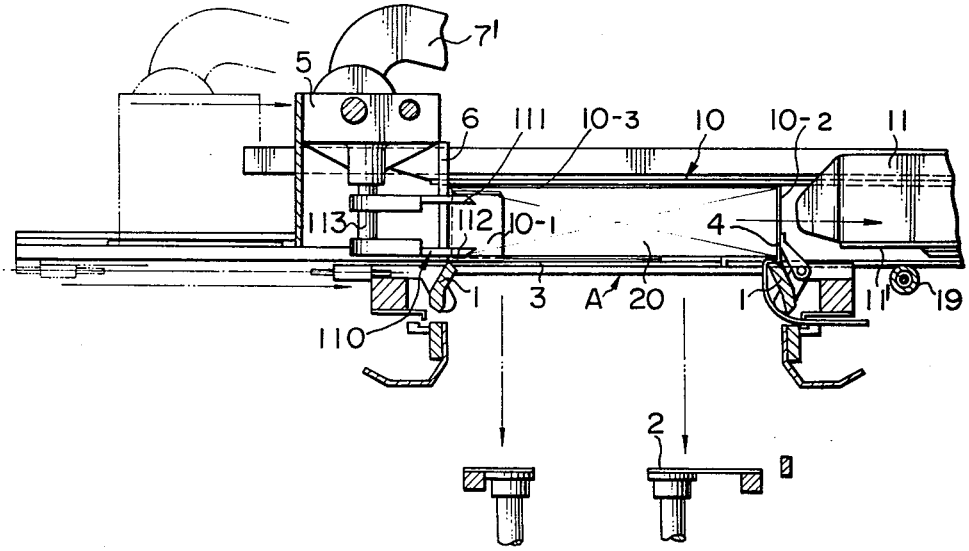
FIGS. 18 and 19 are partially broken-away side views showing a third embodiment of packing apparatus made in accordance with the present invention.
Figure 19:
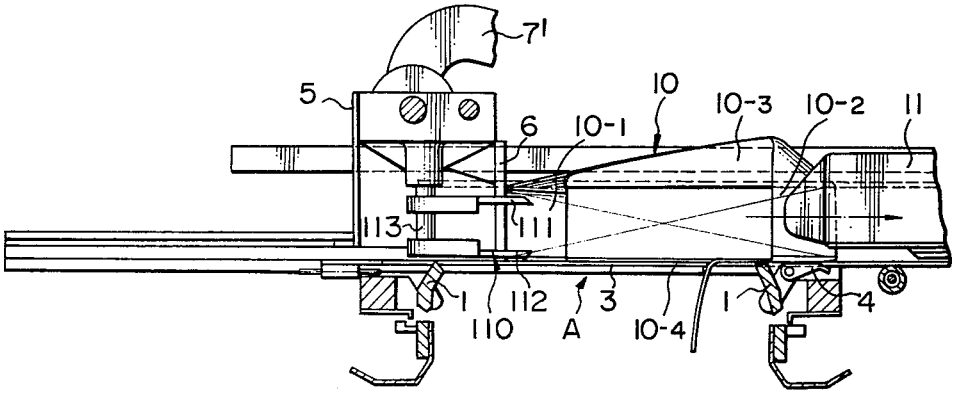
Figure 20:
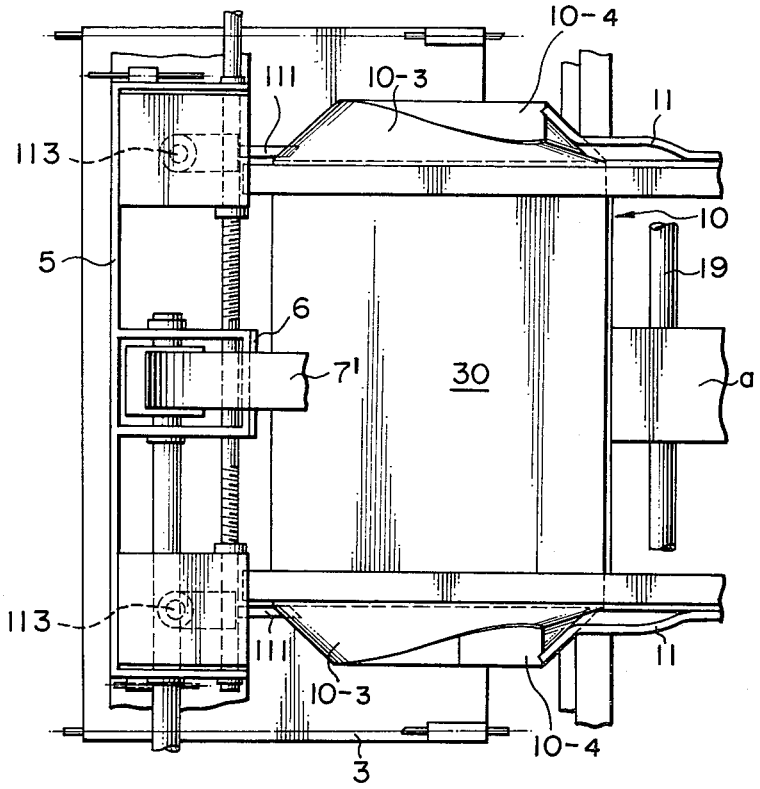
FIG. 20 is a plan view illustrating the apparatus of FIG. 19.

In the embodiment of the apparatus illustrated in FIGS. 18–20, folding means 110 on the side of pusher 6 include folding pawl pairs. Each pair consists of folding, height adjustable pawls 111 and 112 for folding one side edge of each open sheet end portion 10. Folding members 11 as hereinabove described are again provided as the folding means on the other side of the lapping session.

The folding pawls 111 and 112 in each pair are slideably mounted for height adjustment on a vertical support shaft 113 provided on moveable frame 5 and can be fixed in appropriately adjusted vertical positions.

The folding pawls 111 and 112 are mounted at such positions that they can engage the respective ends of the product 20 along its length direction, with the lower folding pawls 112 positioned to extend sidewise directly above supports 1 (i.e., at substantially the same level as the bottom of product 20 resting on supports 1) and the upper folding pawls 111 being height adjustable to coincide with the height of the product 20 and adapted to be fixed in a position substantially at the same level as the top of the product. In other words, the upper and lower folding pawls 111 and 112 in each pair are adapted to be fixed in position such that they are spaced apart by a distance substantially equal to the height of the product 20, so that they can fold the trailing side edge 10-1 of each open end portion of packing sheet 10 lapped around the product 20 over each product end.

The upward folding of upper edges 10-3 of the packing sheet 30 is effected by folding members 11 alone. In other words, after the trailing side edges 10-1 of each open end portion 10 are folded over the product ends by folding pawls 111 and 112, as seen in FIG. 18, product 20 is transferred by pusher 8, and leading side edges 10-2 of open end portions 10 eventually engage the folding members 11. The edges 10-2 are thereby folded over the ends of the product and the upper edges 10-3 are upwardly folded over the entire length of the product along the direction of transfer in a continuous manner, as seen in FIGS. 19 and 20.

Figure 21:
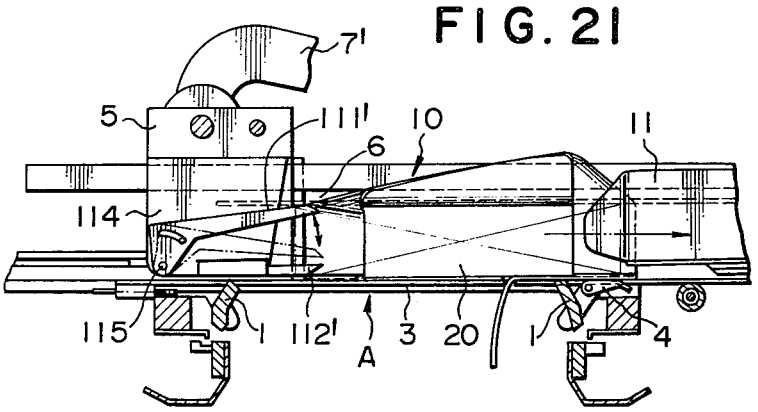
FIG. 21 is a partially broken-away side view illustrating another embodiment of the apparatus as illustrated in FIG. 18.

FIG. 21 illustrates a modification of the folding pawls described in the apparatus of the preceding embodiment. Each lower folding pawl 112' is secured to the lower end of a support member 114 depending from moveable frame 5, and each upper folding pawl 111' is pivoted to the support member 114 at its trailing end by a pin 115. The position of each folding member 111' is pivotably adjustable over the lower folding pawl for height adjustment according to the height of product 20.

Figure 22:
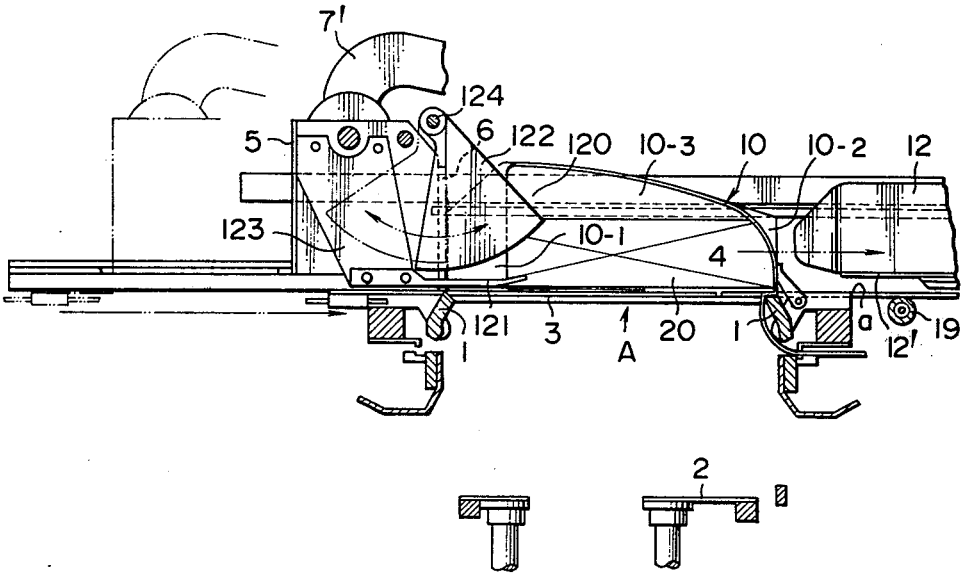
FIGS. 22 and 23 are partially broken-away side views showing a fourth embodiment of packing apparatus made in accordance with the present invention.
Figure 23:
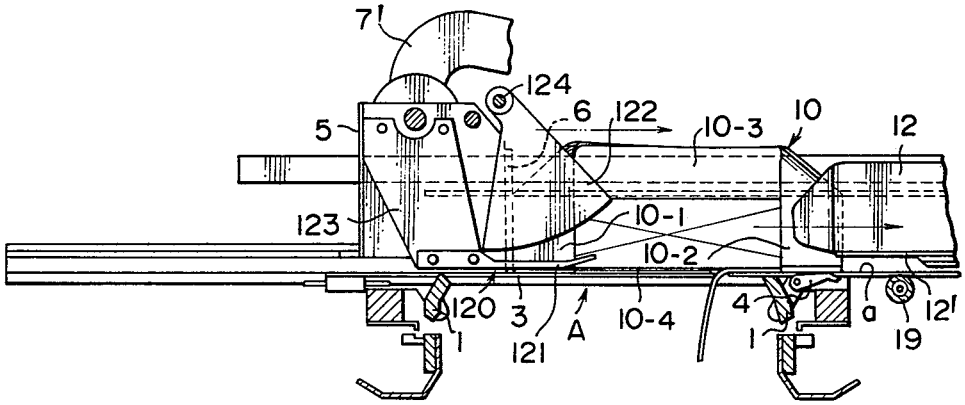
Figure 24:
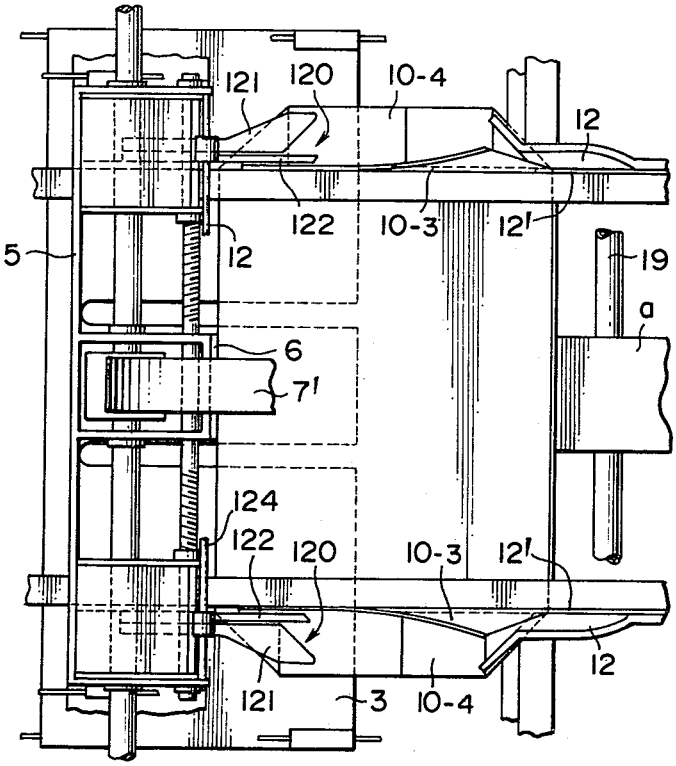
FIG. 24 is a plan view of the apparatus as illustrated in FIG. 23.

In the modification of FIGS. 22 through 24, folding means 120 are provided on each side of the pusher 6 and comprise a folding member 121 extending along the bottom of the product 20 and a swinging member 122 adapted to swing about the corresponding end of the product. The folding pawl 121 is secured to a support member 123 depending from moveable frame 5, and the swinging member 122 is secured to a rotatable shaft 124 rotated by a rotating means and being rotatably mounted upon moveable frame 5 for swinging over the folding pawl 121.

The folding pawls 121 and swinging members 122 are disposed such that they can engage the ends of product 20 in its length direction, and the folding pawls 121 are positioned to extend sidewise directly above the supports 1 (i.e., at substantially the same level as the bottom of the product 20 resting upon supports 1).

The folding members 121 have a length sufficient to extend a suitable amount beyond the pusher 6 in the forward direction of transfer.

The folding means 120 function such that with the movement of the moveable frame 5 toward the packing sheet lapping section A lower portions of the trailing side edges 10-1 of the open end portions 10 of packing sheet 30 extending beyond the ends of the product 20 are folded over the ends of the product by the folding pawls 121. Upward swinging of the swinging members 122 then completes the folding of the side edges 10-1 over the ends of the product and also serves to continuously fold trailing end portions of the upper edges 10-3 upwardly as illustrated in FIG. 22.

Subsequently, product 20 is transferred along transfer path "a" by the pusher and the leading side edges 10-2 and upper edges 10-3 are folded by the folding members 11, as seen in FIGS. 23 and 24.

Figure 25:
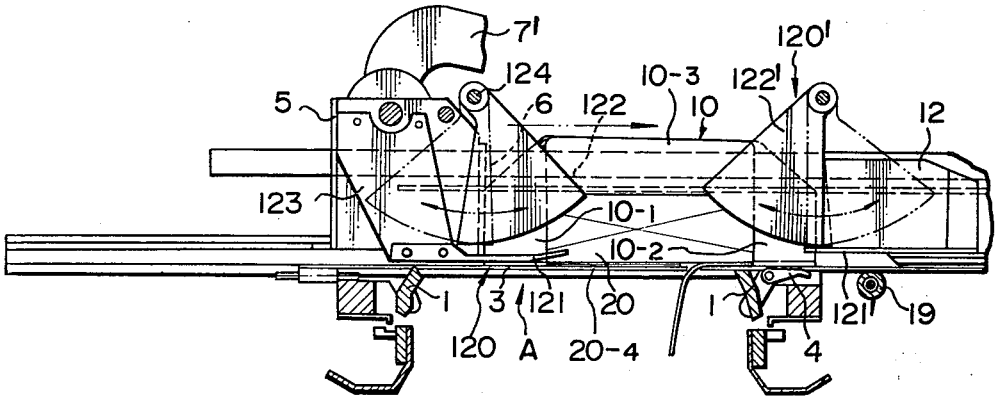
FIG. 25 is a partially broken-away side view of a modification of the apparatus illustrated in FIG. 22.
Figure 26:
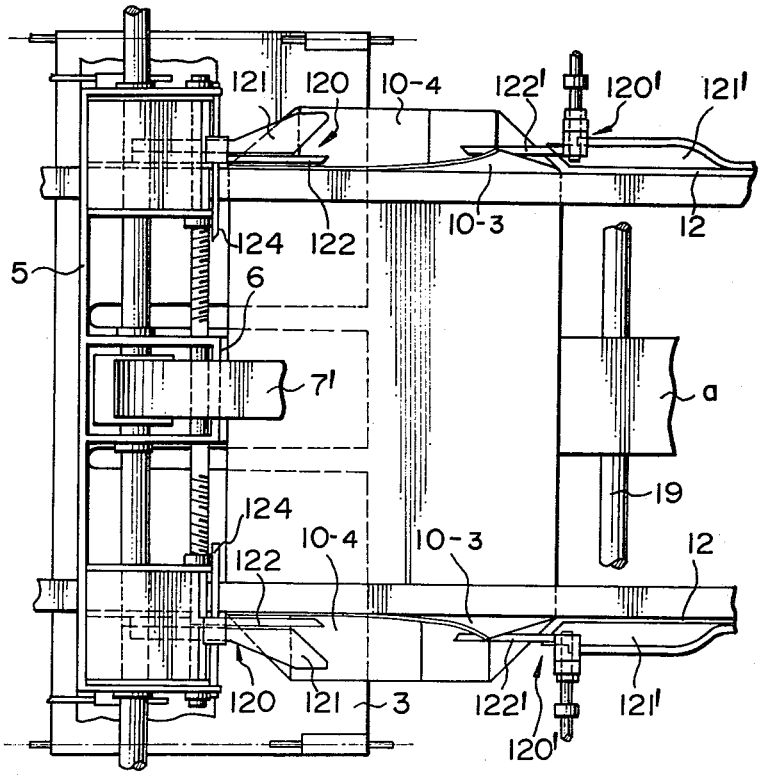
FIG. 26 is a plan view of the apparatus as illustrated in FIG. 25.

In the embodiment of FIGS. 25 and 26, folding means 120' includes folding pawls 121' and swinging members 122' which are provided on the leading side of lapping section A in addition to the above described folding members 120 on the trailing side of the lapping section.

Figure 27:
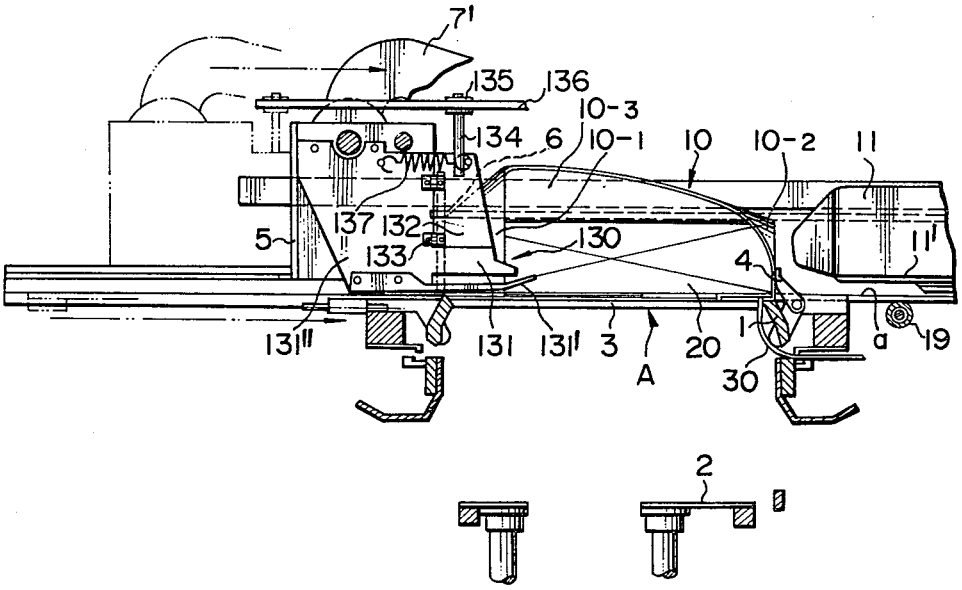
FIGS. 27 and 28 are partially broken-away side views showing a fifth embodiment of packing apparatus formed in accordance with the present invention.
Figure 28:
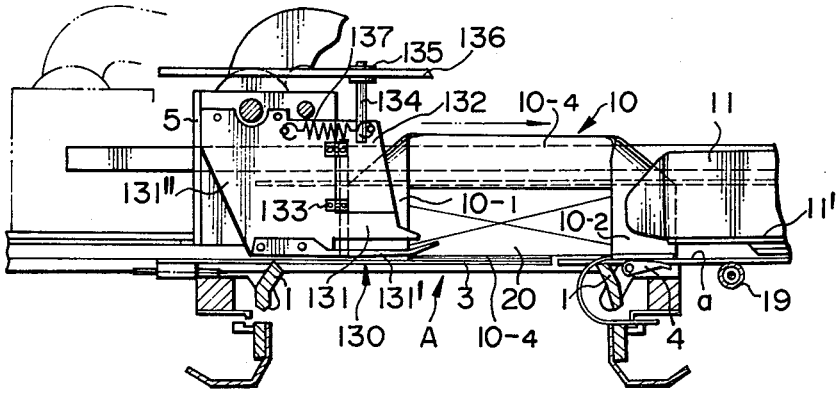
Figure 29:
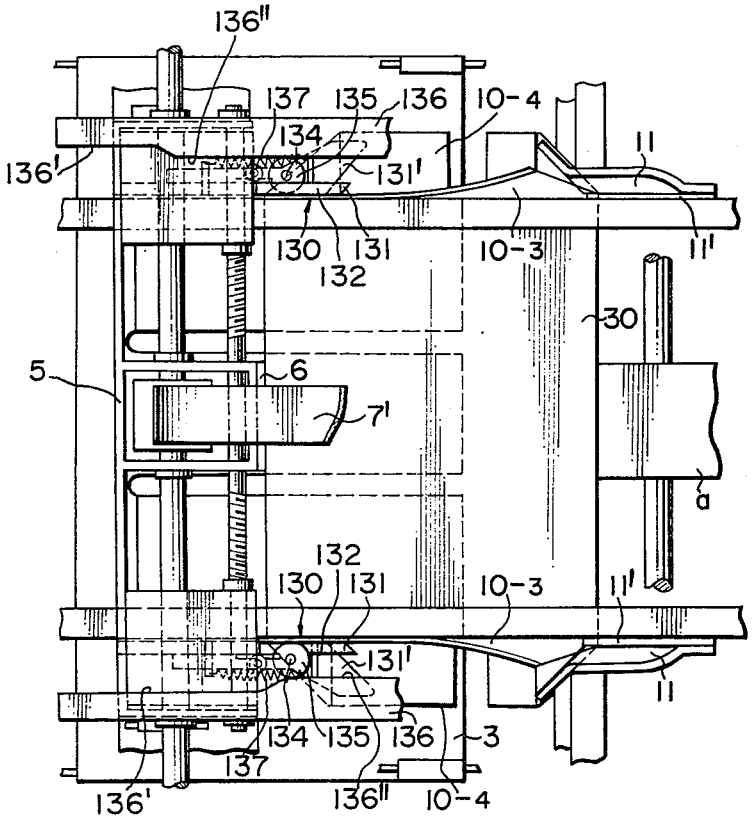
FIG. 29 is a plan view of the apparatus illustrated in FIG. 27.

In the embodiment of FIGS. 27 through 29, folding means 130 on the side of the pusher 6 include folding members 131 extending along the ends of the product and folding members 132 hinged to the respective folding members 131 and adapted to swing toward the ends of the product. Each folding member 131 has a lower edge portion 131' positioned to extend directly above the supports 1. Each member additionally has an L-shaped form consisting of an upright portion 131'' and a lower edge portion 131' and has a length extending beyond the pusher 6 by a suitable distance in the forward transfer direction.

The folding members 132 comprise rectangular plates, each hinged at a tailing edge thereof by hinges 133 to the upright portion 131'' of each folding member 131.

Each folding member 132 is provided with an upwardly projecting integral support shaft 134. Shaft 134 carries a roller 135 rotatably mounted on the upper shaft end. The roller is adapted to roll over the inner surface of an associated guide member 136 and the support shaft 134 is spring-biased by a spring 137 so that the roller 135 is continuously held in contact with the guide member 136.

Guide members 136 each has a guide surface 136' for holding each folding member 132 in an outwardly opened state with respect to the associated roller 135 and support shaft 134. Each guide surface 136' terminates at its leading end in an inwardly inclined surface which in turn terminates in another guide surface 136''. Surface 136'' is inwardly directed relative to guide surface 136' and as roller 135 rolls over the guide member 136 from guide surface 136' to surface 136'' the folding member 132 is pivotally moved up to a position corresponding to the end of the product.

Folding means 130 function so that with the movement of moveable frame 5 toward the packing sheet lapping section A, trailing side edges 10-1 of the open end portions 10 of packing sheet 30 extending beyond the opposite ends of the product 20 are folded over the ends of the product by the folding members 131. With the movement of rollers 135 over the guide members 136 toward the guide surfaces 136'', the folding members 132 are pivotally moved toward the product to fold upper portions of the side edges 10-1 while folding the upper edges 10-3 adjacent thereto vertically upward, as seen in FIG. 27. Then, with the subsequent transfer of product 20 by pusher 6, the leading side edges 10-2 and upper edges 10-3 are folded by the folding members 11 in the same way as described hereinabove, as seen in FIGS. 28 and 29.

Figure 30:
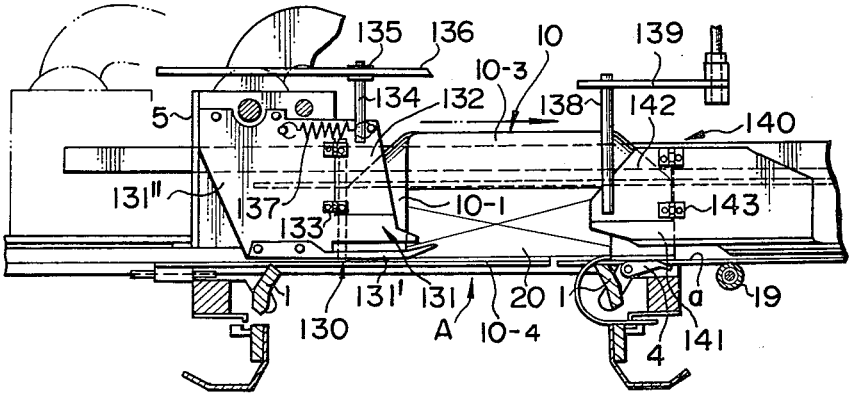
FIG. 30 is a partially broken-away side view illustrating a modification of the apparatus illustrated in FIG. 27.
Figure 31:
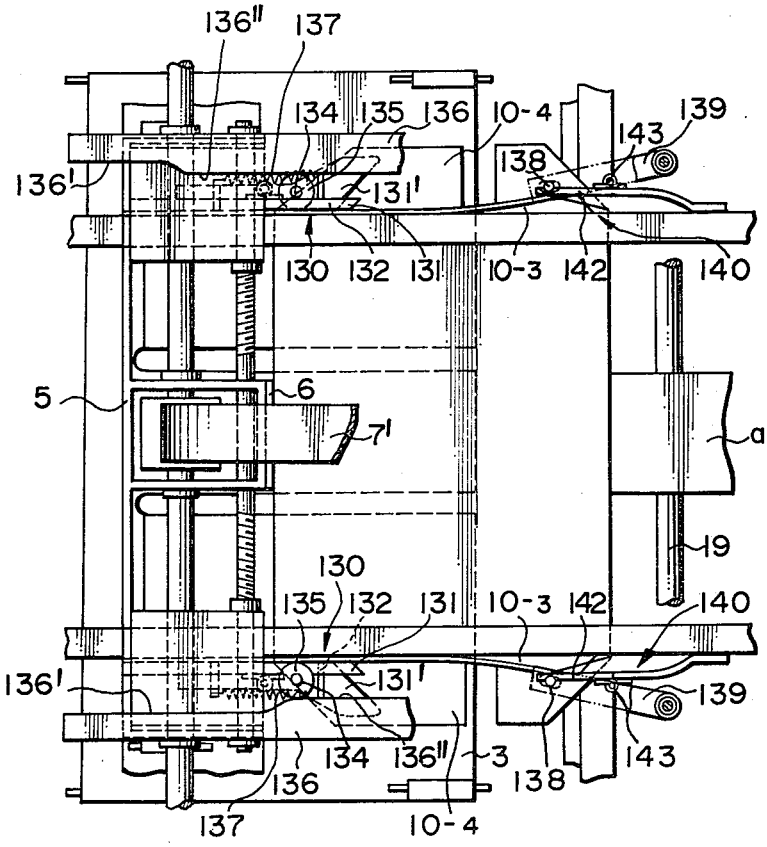
FIG. 31 is a plan view of the apparatus illustrated in FIG. 30.

In the embodiment of FIGS. 30 and 31, folding means 140 including folding means 141 and 142 are provided in lieu of the folding members 11. Each folding member 141 has a turned-over substantially L-shaped form attained by removing a trailing end upper portion of the folding member 11, and each folding member 142 is hinged by hinges 143 to each folding member 141 to occupy the turned-over L-shaped space on the side of the product 20.

Each folding member 142 has an integral, upwardly projecting rod member 138 engaging a drive lever 139. The drive lever is adapted to pivotably move folding member 142 toward the product 20 via rod member 138.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. Apparatus for packing a product having two opposed ends, two opposed sides, a top surface, and a bottom surface, said apparatus comprising:

(a) a packing sheet lapping section for lapping a packing sheet around said product, said lapping section having a leading and a trailing side, said packing sheet having opposed end portions adapted to extend beyond said opposed ends of said product, each end portion including an upper edge adapted to extend beyond the top product surface, a lower edge adapted to extend beyond the bottom surface of said product and opposed leading and trailing side edges;

(b) a product transfer path located adjacent to said leading side of said lapping section;

(c) a pusher located adjacent to said trailing side of said lapping section, said pusher adapted to move said product along said transfer path;

(d) first folding means located adjacent said trailing side of said lapping section for folding side edges of said packing sheet end portions over said product ends and simultaneously upwardly folding upper edges of said end portions above said top surface of said product, said first folding means comprising at least one generally upright support member mounted on a moveable frame, folding pawls which extend adjacent to the bottom surface of said product, said folding pawls being mounted on said generally upright support member, said first folding means further comprising swinging members positioned above said pawls, said swinging members being adapted to swing along said product ends, said swinging members being attached to rotatable shafts which are rotatably mounted upon said moveable frame, and means for moving said frame and swinging said members so that said pawls fold said side edges and said swinging members upwardly fold said upper edges;

(e) second folding means for folding lower edges of said end portions over said product ends; and (f) third folding means for folding said upper edges of said end portions over said product ends after they have been upwardly folded, said second and said third folding means being positioned along said transfer path.

2. Apparatus for packing a product having two opposed ends, two opposed sides, a top surface, and a bottom surface, said apparatus comprising:

(a) a packing sheet lapping section for lapping a packing sheet about a product, said lapping section having a leading and a trailing side, said packing sheet having opposed end portions adapted to extend beyond the opposed ends of said product, each end portion including an upper edge adapted to extend beyond the top product surface, a lower edge adapted to extend beyond the bottom surface of said product and opposed leading and trailing side edges;

(b) a product transfer path adjacent to said leading side of said lapping section;

(c) a pusher located adjacent to said trailing side of said lapping section, said pusher adapted to move said product along said transfer path;

(d) first folding means located adjacent said trailing side of said lapping section for folding side edges of said packing sheet end portions over said product ends and simultaneously upwardly folding upper edges of said end portions to extend above said top surface of said product, said first folding means comprising a moveable frame, first and second folding members, said first folding members extending along said product ends and mounted on said moveable frame, each first folding member having a generally L-shaped form including an upright portion and a lower edge portion extending adjacent to said bottom product surface, each second folding member being hinged to one of said first folding members and being pivotable away from and toward one of said product ends, each second folding member comprising a generally rectangular plate having a front edge and a rear edge and being hinged at said rear edge to the upright portion of one first folding member, and means for moving said frame and pivoting said second folding members so that said first folding members fold said side edges and said second folding members upwardly fold said upper edges;

(e) second folding means for folding lower edges of said end portions over said product ends; and (f) third folding means for folding said upper edges of said end portions over said product ends after they have been upwardly folded, said second and said third folding means being positioned along said transfer path.

3. Apparatus for packing a product in accordance with claim 2 wherein each of said second folding members is provided with an upwardly projecting integral support shaft, each support shaft carries a roller rotatably mounted on one end of the shaft, each support shaft is spring-biased by a spring and each roller is biased into contact with a guide member by said spring.

4. Apparatus for packing a product in accordance with claim 1, wherein said first folding means also comprise folding pawls and swinging members located adjacent to said leading side of said lapping section.

5. Apparatus for packing a product in accordance with claim 2, wherein said first folding means further comprises additional first folding members and second folding members, adjacent to said lapping section leading side which are similar to the first folding members and the second folding members which are located adjacent to said lapping section trailing side.

6. Apparatus for packing a product in accordance with either of claims 4 or 5, wherein said packing sheet is rectangular.

7. Apparatus for packing a product in accordance with either of claims 4 or 5, wherein said lapping section includes adjustably positioned trailing and leading side supports for receiving products of differing widths, an elevator located beneath said supports, bottom folding members positioned adjacent said leading side, said bottom folding members adapted for horizontal reciprocal movement between said supports and support pawls located adjacent to said leading side supports which are adapted to be held upright until a predetermined load is applied, whereby a packing sheet corresponding in size to said product can be supplied between said supports and said elevator.

8. Apparatus for packing a product in accordance with either of claims 4 or 5, wherein said second folding means comprises vertical plates each having a main portion of a given height and a trailing end inclined upwardly toward said main portion.

9. Apparatus for packing a product in accordance with either of claims 4 or 5, wherein said third folding means comprises rod-like upper edge folding members.

10. Apparatus for packing a product in accordance with either of claims 4 or 5, further comprising a return member for folding said upwardly folded upper edges of said end portion into a horizontal position before said upper edges are folded by said third folding means, and means for horizontally guiding said horizontal upward edges toward said third folding means.

11. Apparatus for packing a product in accordance with either of claims 4 or 5, including means for gluing said upper edges to said lower edges.

* * * * *